US005273504A

United States Patent [19]

Jones

[11] Patent Number: 5,273,504

[45] **Date of Patent: * Dec. 28, 1993**

[54] BEHIND THE NECK PULLDOWN EXERCISE MACHINE

[75] Inventor: Gary A. Jones, Falmouth, Ky.

[73] Assignee: Hammer Strength Corporation, Cincinnati, Ohio

[ * ] Notice: The portion of the term of this patent subsequent to Sep. 24, 2008 has been disclaimed.

[21] Appl. No.: 759,888

[22] Filed: Sep. 13, 1991

[51] Int. Cl.[5] ..... A63B 21/08

[52] U.S. Cl. ..... 482/97; 482/133; 482/142

[58] Field of Search ..... 482/97, 134, 92, 93, 482/133, 139, 142, 145

[56] References Cited

U.S. PATENT DOCUMENTS 4,732,380 3/1988 Maag ..... 482/145
5,050,873 9/1991 Jones ..... 482/97

OTHER PUBLICATIONS

The Nautilus Book, by Ellington Darden PhD Copyright 1982, Cover Copyright pg, pp. 102 and 103 The "Compound Position Biceps Machine".

Nautilus Midwest Brochure (4 pp.).

Hammer Strength Brochure (12 pp.).

Leverage Machines by Nautilus Instruction Manual (24 pp.).

Cybex Brochure (6 pp.).

*Primary Examiner*—Richard J. Apley
*Assistant Examiner*—Jerome Donnelly
*Attorney, Agent, or Firm*—Wood, Herron & Evans

[57] ABSTRACT

A behind the neck pulldown exercise machine includes a frame, a seat connected to the frame to support an exerciser facing a forward direction and a pair of pivotal levers connected to the frame on opposite sides of the seat. The forward ends of the levers include hubs for holding selected weight resistance while the rearward ends include angled handles located above the seated exerciser's head when the levers are in an at rest position. The handles are adapted to be grasped by the seated exerciser and pulled downwardly in a behind the neck pulldown motion to pivot the levers with respect to the frame through planes which tilt downwardly toward the seat. Pads located in front of the seat engage the tops of the thighs of the seated exerciser to prevent upward movement of the exerciser during pulldown.

16 Claims, 4 Drawing Sheets

BEHIND THE NECK PULLDOWN EXERCISE MACHINE

FIELD OF THE INVENTION

This invention relates to exercise equipment. More particularly, this invention relates to an exercise machine for exercising a muscle group which includes the latissimus dorsi, the rhomboids, and the anterior and posterior deltoids through a behind the neck pulldown motion.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines in order to maximize the effect of working out a desired number of muscle groups.

Free weights offer a number of advantages over exercise machines. For instance, they are relatively inexpensive in comparison to exercise machines. Free weights are also more versatile because a variety of exercises can be performed with one set of weights, whereas most exercise machines are designed for only one exercise. Even though some exercise machines accommodate more than one exercise, the cost of these machines usually increases proportionately with the number of exercises. Use of dumbbells also enables both arms to be exercised independently. Finally, free weights are popular among many weight lifters because the lifting movements are not restricted to prescribed planes of motion or prescribed angles.

Nevertheless, there are also a number of inherent disadvantages associated with free weights. One such disadvantage relates to safety. Although most weight room instructors strongly advise against an individual working out by himself or herself, this cautionary measure is particularly important when the lifting of free weights is involved. This is due to commonly recognized dangers such as the possibility of dropping a weight on a body part, or becoming trapped beneath a bar, which could easily occur in exercises such as bench press, incline press or squat. Additionally, through carelessness, loading and unloading of heavy weighted plates onto the ends of a bar sometimes results in an unbalanced bar that falls downward from its rack.

Another disadvantage associated with some free weight exercises relates to the body positioning required to perform a prescribed maneuver. The location of the weights with respect to the body may be awkward and/or dangerous. Finally, due to gravity, for some movements designed to exercise a muscle group in a particular way, a weight resistance simply cannot be applied against the muscular movement without a machine. One such exercise movement is referred to as a behind the neck pulldown. This movement exercises a muscle group which includes the latissimus dorsi, the rhomboids, the anterior and posterior deltoids, and the trapezius. Starting with arms extended above the head, the exerciser pulls downwardly to a position behind the neck. Thus, the motion is downward and rearward, while the applied resistance against this muscle group is directed upwardly and forwardly.

Perhaps an exercise maneuver which best exercises this muscle group through this motion is a pull up performed with arms spread, palms facing forward and, in uppermost position, with the head of the exerciser pulled up in front of the bar. During this motion, the weight resistance of the body applies downward force, but there is also some forward resistance felt by the exerciser, because the torso moves forward as the body is pulled upwardly. With arms extended, the bar is in front of the head. When the body is pulled up, the bar is behind the head.

While a pull up performed this way is an extremely effective exercise for the above-described muscle group, it also has a number of limitations. First, many people simply cannot lift their own weight, and this manner of pull up requires that the exerciser be able to lift at least his or her weight. Second, a pull up cannot be performed one-handed. One important aspect of weight training involves the isolation of muscle groups on both sides of an exerciser's body, so that the arms or the legs can be exercised independently, or simultaneously, depending on the circumstances. Particularly during rehabilitation, single limb exercise enables an exerciser to measure and compare the relative strength of an injured limb to the strength of the healthy limb, so that rehabilitation progress can be monitored.

Some exercise machines provide a pulley/cable exercise device referred to as a lat pulldown, wherein a pulley restricted bar is held at opposite ends and pulled downwardly by an exerciser to a position behind the head, from either a seated or kneeling position. For several reasons, this motion does not work the above-described muscle group as effectively as the pull up.

First, the resistance is directed upwardly, or vertical, with no transverse resistance felt by the exerciser. While an exerciser using this device may lean the torso forward during the pulldown motion, this compound pulling/leaning movement does not apply transverse resistance to the desired muscle group. In other words, this lat pulldown device does not track the natural position of the muscles through a behind the neck pulldown motion. Finally, this machine can only be operated one arm at a time.

Perhaps due to costs, or due to a mistaken perception that the behind the neck pulldown exercise motion is relatively unimportant, applicant is unaware of any exercise machine which exercises the behind the neck pulldown muscle group in a sufficient manner.

It is an object of the invention to provide an exercise machine which maximizes the muscular benefit attainable during performance of a behind the neck pulldown motion by applying resistance against the natural body motion throughout this movement.

It is another object of this invention to provide a behind the neck pulldown exercise machine which is particularly suitable for exercising one arm at a time.

It is another object of the invention to provide a behind the neck pulldown exercise machine which combines the advantageous features of both free weight exercise and exercise machines without incorporating the attendant disadvantages normally associated therewith.

SUMMARY OF THE INVENTION

This invention contemplates a behind the neck pulldown exercise machine which includes a frame, a seat connected to the frame for supporting an exerciser along a vertical midplane through the frame, and a pair of levers pivotally connected to opposite sides of the frame above and in front of the seated exerciser, with the levers being pivotal through planes of motion which tilt downwardly toward the midplane.

Each of the forward ends of the levers is adapted to hold at least one removable weight to provide a selectable weight resistance, while each of the rearward ends of the levers includes a handle adapted to be grasped above the head of the seated exerciser and pulled downwardly behind the neck in a behind the neck pulldown motion to pivotally raise the weighted forward end. The machine also includes a hold-down support located in front of the seat which bears against the tops of the thighs of the seated exerciser to prevent upward movement of the exerciser during pulldown of the handles.

This behind the neck pulldown exercise machine facilitates safe and efficient performance of a behind the neck pulldown motion to exercise a muscle group which includes the latissimus dorsi, the rhomboids, the anterior and posterior deltoids and the trapezius. More importantly, the structural orientation of the frame, including the tilted planes of motion through which the levers move, the locations of the pivot points with respect to the seat, the locations of the handles above the exerciser and the angles of the handles with respect to the exerciser's body all combine to accommodate the natural musculoskeletal make-up of the human body. Based upon feedback from a number of individuals involved in the field of strength training, this behind the neck pulldown exercise machine seems to more naturally fit the body. That is, this machine enables an exerciser to couple the exertable force against a selected weight resistance in a manner which, compared to a pull up or a lat pulldown device, moves in a compound direction which feels more compatible with the natural angles through which the body normally moves. The use of weighted levers provides the necessary upward and forward weight resistance during this motion. Moreover, the tilt angles and handle angles better accommodate natural muscular position during this motion. As a result, maximum muscular benefits for this muscle group during this motion are achieved with this machine.

Because it has two independently pivotal levers, this behind the neck pulldown exercise machine enables the performance of either simultaneous or alternate exercise of both arms. This feature is particularly advantageous in monitoring rehabilitation progress after an injury, where it is often necessary to compare the relative strengths of the arms.

In a related aspect of this feature, the levers are substantially balanced, with the weight of the forward ends being slightly greater than the rearward ends. As a result, for each lever, the total moment about the pivot axis is very low, and the minimum weight that must be exercised against, i.e., with no weight plates supported, is very low. Therefore, and also because the pivotal lever has substantially no friction, the weights supported on the lever closely approximate the actual weight resistance that is exercised against. This feature becomes important during the initial stages of rehabilitation, when it may be required to exercise against very low weight resistance and keep highly accurate records of actual weight lifted. In short, this machine facilitates the monitoring and measuring of rehabilitation progress through very low weight resistances.

In accordance with a preferred embodiment of the invention, a behind the neck pulldown exercise machine includes a frame, a seat connected to the frame along a vertical midplane, a pair of levers pivotally connected to the frame above and in front of the seat, with the levers adapted to be pivoted through planes of motion which tilt downwardly toward the vertical midplane. When in an at rest position, forward ends of the levers rest against the frame, angled downwardly from horizontal, thereby placing the rearward ends above the head of an exerciser supported on the seat. Forward ends of the levers include outwardly directed hubs, each adapted to hold at least one removable weight to enable an exerciser to provide a desired weight resistance. The forward ends of the levers also include stops for resting against the frame when in an at rest position. Rearward ends of the levers include angled handles located above the head of the exerciser when the levers are in an at rest position. A pair of pads located in front of the seat engage the upper thighs of an exerciser supported on the seat. The pads prevent upward movement of the exerciser during the pulldown motion. Like the seat, the pads are vertically adjustable with respect to the frame to accommodate exercisers of different size.

The handles are adapted to be grasped by the exerciser and pulled downwardly through a behind the neck pulldown motion to pivotally raise the weights supported at the forward ends of the levers. As a result of the orientation of the lever pivot planes and the handle angles, a person supported on the seat is able to maximize the muscular benefits attainable when performing a behind the neck pulldown exercise, while at the same time minimizing the joint stress felt by the joints associated with this muscle group.

The structural orientation of this behind the neck pulldown exercise machine evolved from applicant's belief that most exercise machines oversimplify the musculoskeletal movements of the human body. While his accumulated years of observing and analyzing athletic movements of the body led him to conclude that most musculoskeletal movements are rather complex and involve multiple joints and multiple degrees of freedom, he also recognized that most exercise machines require bodily movement in directions or planes that are oriented simply at right angles or parallel to the torso of the body.

Based on these observations, and bolstered by his opinion that the ultimate objective of any exercise machine is to provide maximum muscular benefit with minimum joint stress, applicant perceived a need for improvement in the design of exercise machines and began working toward that goal. Feedback from athletes who have used this inventive behind the neck pulldown exercise machine has confirmed that it constitutes a marked improvement over other methods for performing a behind the neck pulldown exercise.

This behind the neck pulldown exercise machine provides the benefits of both free weight exercise and exercise with weight machines, without incorporating the attendant disadvantages commonly associated with these methods of exercising.

These and other features of the invention will be more readily understood in view of the following detailed description and the drawings in which:

DETAILED DESCRIPTION OF THE DRAWINGS

Figure 1:
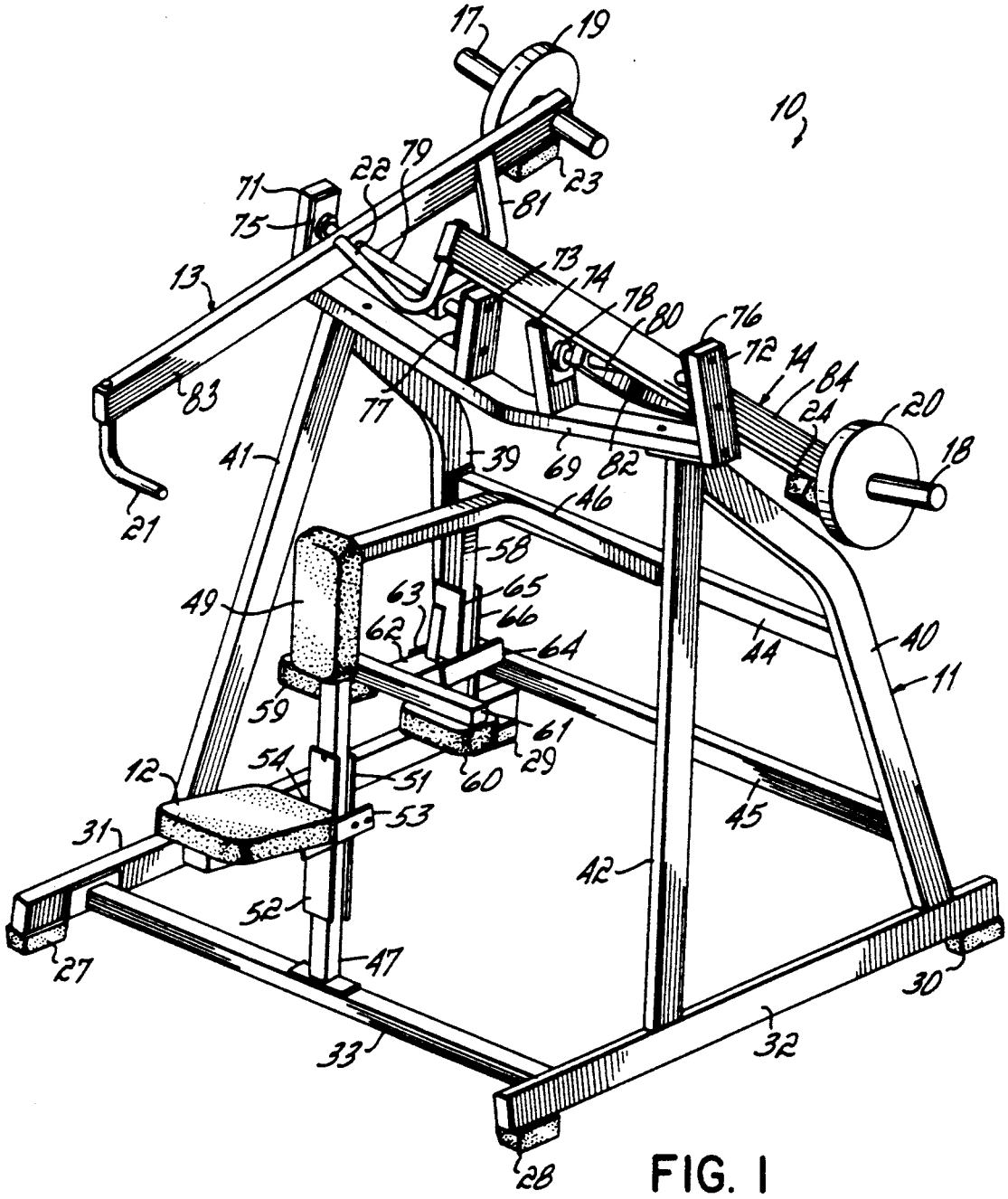
FIG. 1 is a perspective view of a behind the neck pulldown exercise machine in accordance with a preferred embodiment of the invention.

FIGS. 1–4 show a behind a neck pulldown exercise machine 10 in accordance with a preferred embodiment of the invention. This machine includes a frame 11 made of a number of straight and/or curved sections of heavy duty steel that are either welded or bolted together, or pivotally connected. A seat 12 is connected to the frame 11. Levers designated generally by numerals 13 and 14 are pivotally connected to the frame 11 above and forward of seat 12. The seat is aligned along a vertical midplane 15 (shown in FIG. 2), and the frame 11 is symmetric with respect to the midplane 15. Thus, levers 13 and 14 are located on opposite sides of the midplane 15.

In describing the details of the machine 10, components which are symmetrical with respect to midplane 15 have been numbered so that the odd numbered component resides to the left of the midplane 15 and the next higher even number designates the corresponding symmetric component residing on the right side of the midplane 15 (with respect to the forward facing direction of the seat 12).

Each lever has forward end equipped with a weight supporting hub and a stop, and a rearward end to which a handle is connected. As shown in FIG. 1, lever 13 includes hub 17 for supporting at least one removable weight 19 at the forward end thereof. The lever 13 also includes a handle 21 connected at a rearward end adapted to be grasped and pulled downwardly by an exerciser supported on the seat 12. Rubber stop 23 is also connected to the forward end of lever 13 to limit downward pivotal movement of lever 13 with respect to frame 11. Similarly, lever 14 includes hub 18 for supporting at least one removable weight 20 thereon, handle 22, and rubber stop 24.

The frame 11 is supported at the bottom by left supports 27 and 29 and right supports 28 and 30. These supports are mounted to bottom member 31 on the left and bottom member 32 on the right, respectively. Members 31 and 32 are connected at the rear of the frame 10 by central member 33. Preferably, bottom central member 33 is connected to members 31 and 32 by end welded plates with through holes formed therein for bolted securement to members 31 and 32. If desired, plates may be substituted for supports 27, 28, 29 and 30, with holes through the plates for securement of the machine 10 to a portable base, or to facilitate transport of the machine 10.

As indicated previously, the sides of the frame 11 tilt downwardly toward the vertical midplane 15. Thus, each of the components on the left and right sides of the frame 11 have an inward tilt of about 10°. On the left side of the midplane 15, front leg 39 and rear leg 41 extend upwardly from bottom member 31. On the right side of the frame 11, front leg 40 and rear leg 42 extend upwardly from bottom member 32. At the forward end of the frame 11, upper brace 44 and lower brace 45 interconnect the front legs 39 and 40. Center brace 46 extends rearwardly from upper brace 44 and is connected to central upright 47, which extends upwardly from central member 33. There is a slight bend in brace 46.

Central upright 47 has a cushioned pad 49 mounted thereon for supporting the chest of an exercise (not shown) during performance of a behind the neck pulldown exercise. Two resilient planar pieces 51 and 52 are mounted to rearward and forward surfaces, respectively, of upright 47. Spaced parallel supports 52 and 53 extend forwardly from under seat 12 and are interconnected by a pair of horizontal spaced rods (not shown) which fit snugly on opposite sides of the planar pieces 51 and 52.

To raise or lower the seat 12 with respect to upright 47, the forward end of the seat 12 is tilted upwardly with respect to upright 47 so that the spaced parallel bars move away from, or provide clearance from pieces 51 and 52. In this orientation, the seat 12 may be moved upwardly or downwardly along the planar pieces 51 and 52, in a direction parallel to upright 47. When the forward end is subsequently tilted downwardly, the parallel bars of the seat 12 will frictionally engage the planar pieces 51 and 52 to hold the seat 12 in place. Any number of other methods for providing adjustability for the seat 12 along upright 47 would also be suitable.

Vertical member 58 extends downwardly from central brace 46 in front of the seat 12. The structural components supported on member 58 prevent upward movement of an exerciser supported on the seat 12 during a behind the neck pulldown exercise. Pads 59 and 60 are mounted to a cross bar 61 and located in a position in front of the seat 12 to engage the tops of the thighs of an exerciser supported on the seat 12. Cross bar 61 is welded to a connector 62 to which vertically oriented, parallel spaced plates 63 and 64 are connected. Horizontal, parallel rods (not shown) interconnect the forward ends of spaced plates 63 and 64 to engage the forwardly and rearwardly directed surfaces of resilient planar pieces 65 and 66, respectively, which are mounted to the forward and rearward surfaces of member 58, respectively. The vertical position of the pads 59 and 60 may be raised or lowered with respect to member 58 by manipulating the cross bar 61 and the parallel rods, similar to the manner described above for adjusting seat 12 along upright 47.

The frame 11 further includes a top brace 69 which interconnects rear legs 41 and 42. Top brace 69 also supports the work boxes, or the structural components which mount the levers 13 and 14. Top brace 69 includes a centrally located bend to accommodate the inward tilt of the sides of the frame 11.

For each of the levers, the work box includes spaced, inwardly tilting uprights mounted to top brace 69. Uprights 71 and 73 are located on the left of brace 69, while uprights 72 and 74 are located on the right side of midplane 15. Bearings 75 and 77 are mounted to the inward and outward directed surfaces of uprights 71 and 73, respectively. Similarly, bearings 76 and 78 are mounted to the inwardly and outwardly directed surfaces of uprights 72 and 74. Axle 79 is connected to bearings 77 and 75, and axle 80 is connected to bearings 76 and 78. The axles pivot within the bearings to provide pivotal motion for the levers. While any one of a number of different bearings would work, applicant has found that a pillow block bearing sold by Browning, Part No. VF 2S 116 has proved suitable. These bearings require maintenance only once a year, maintenance which consists of one shot of lubricating oil. Diagonal brace 81 and lever body 83 are rigidly connected to axle 79 for pivotal motion therewith. Similarly, diagonal brace 82 and lever body 84 are rigidly connected to axle 80 for pivotal motion therewith.

Figure 2:
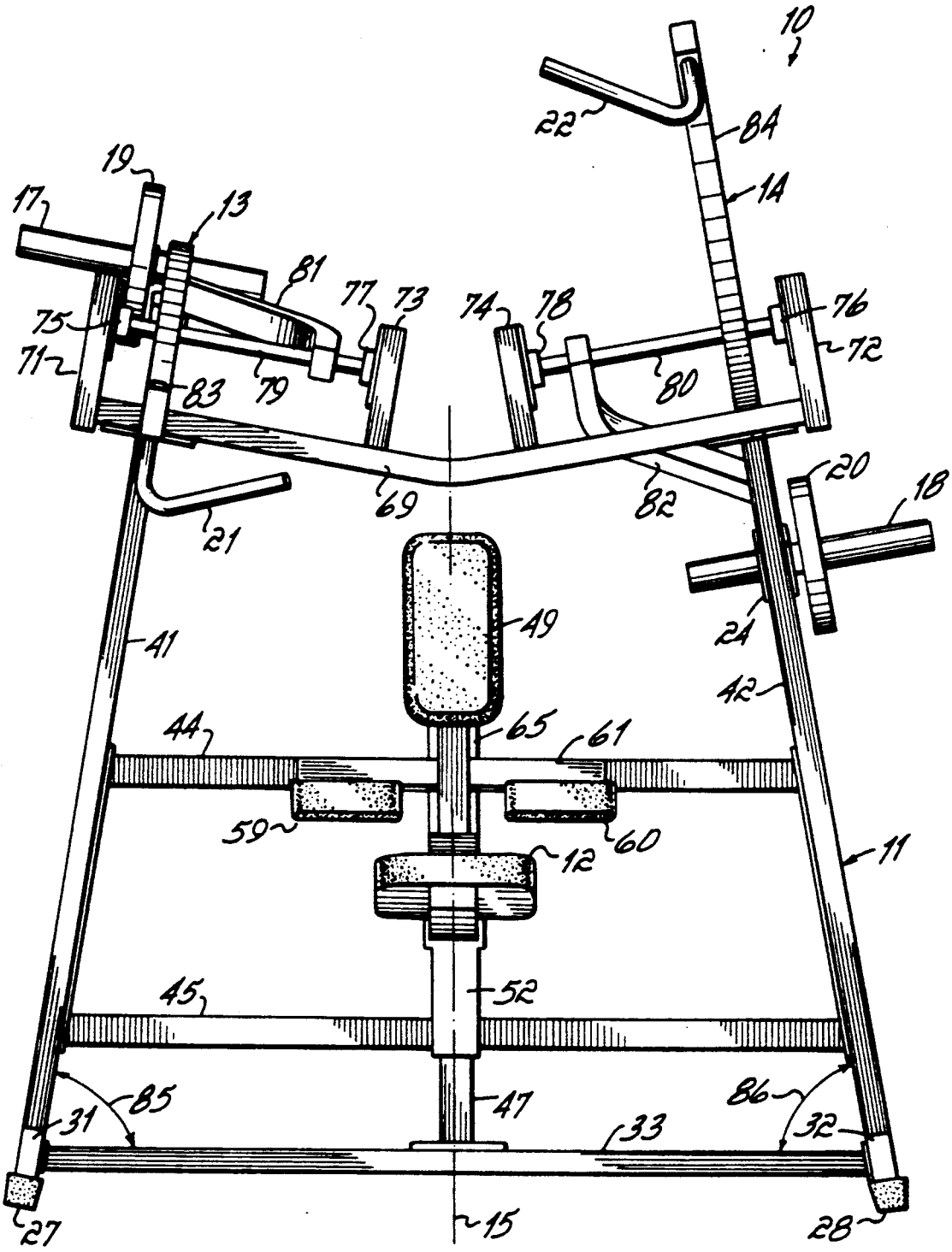
FIG. 2 is a rear view, looking forward, of the behind the neck pulldown exercise machine shown in FIG. 1.

As shown best in FIG. 2, the sides of the frame 11 tilt inwardly towards vertical midplane 15. This inward tilt is designated by numeral 85 on the left and by numeral 86 on the right, and this angle is preferably about 10° from vertical. As an additional benefit of this tilt, the weights are less likely to fall off the ends of the hubs.

Figure 3:
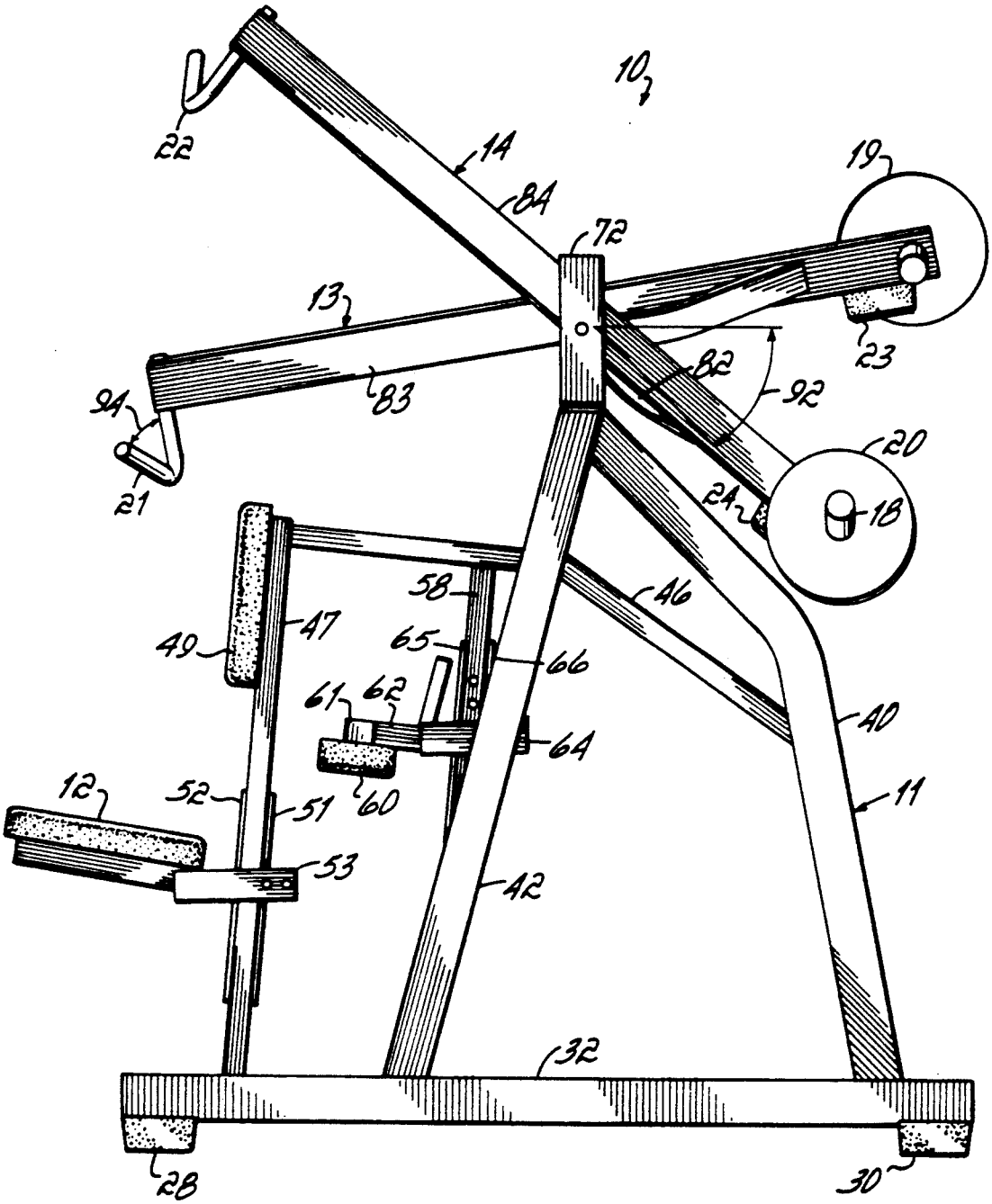
FIG. 3 is a side view of the behind the neck pulldown exercise machine shown in FIG. 1.
Figure 4:
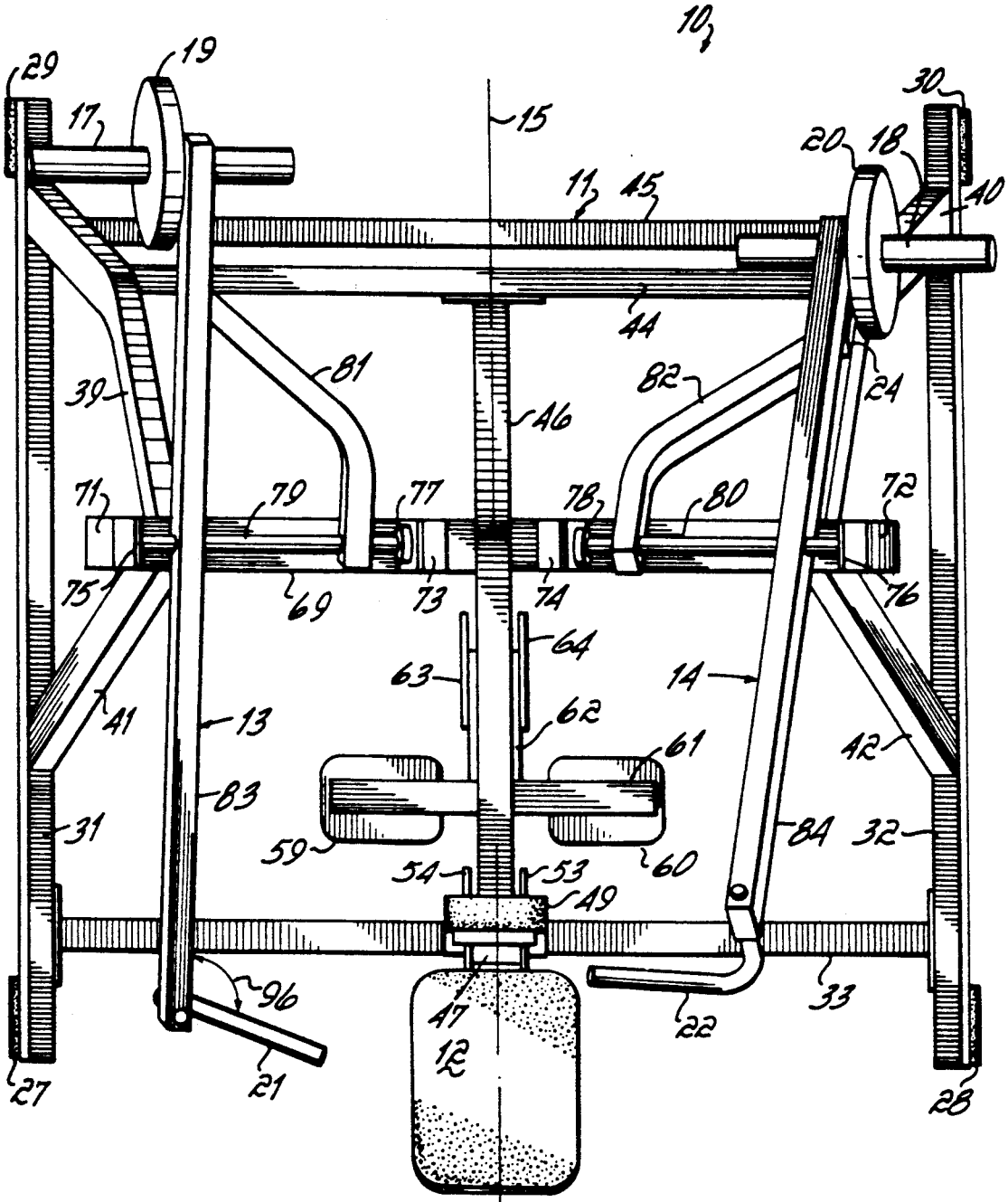
FIG. 4 is a plan view of the behind the neck pulldown exercise machine shown in FIG. 1.

As shown in FIG. 3, upright 47 tilts slightly forward a few degrees, and seat 12 is angled at slightly less than 90° with respect to upright 47. Numeral 90 designates the vertical distance from the floor to the outer, upper bearings 75 and 76, and this distance is preferably about 55½". The vertical distance from the floor to the inner, lower bearings 77 and 78 is preferably about 52⅝". Each lever body has a total length of about 53". The pivot point of each lever body is located about 29" forward of the rear end thereof, where the handles are located. This leaves a remaining distance of about 24" from the pivot point to the forward ends, where the hubs and stops are located. Due to the weight of the diagonal braces, the hubs and the stops, the forward ends of the levers weigh slightly more than the rearward ends so that, when at rest, the position of the lever body is about 45° downward from vertical, an angle designated by numeral 92.

Each of the handles 21 and 22 is actually a bent metal rod which has been bent to form a first portion which is connected to the rearward end of the respective lever body, and a second portion which is grasped by an exerciser. The two portions of each handle are separated by an angle of about 65°, an angle designated by numeral 94 in FIG. 3. This means that, starting with a straight piece of metal, i.e., 180°, one end is bent toward the other through an angle of 115°, so that the two portions are then separated by an angle of 65°. Preferably, the first portions of the handles are received within holes formed in the rearward ends of the levers and then welded therein. The second portions of the levers are oriented at angles rotated about 108.5° from the forward direction of the respective lever body, an angle designated by numeral 96 in FIG. 4.

In operation, an exerciser supports himself or herself on seat 12, with the chest leaning against pad 49 so that the exerciser faces a forward direction. Initially, forward ends of the levers 13 and 14 are down, with pads 23 and 24, respectively, contacting the frame 11. The exerciser reaches up to grasp the handles 21 and 22 of levers 13 and 14, respectively, with the palms facing forward and the thumbs pointed inward. By pulling downwardly on the handles, the exerciser moves the levers in arcuate paths along planes of lever motion which tilt downwardly from vertical toward the midplane. The pulling force exerted by the exerciser is directed downwardly and slightly rearwardly during pivotal movement of the levers.

As mentioned previously, frame 11 enables a person to perform a behind the neck pulldown exercise, either simultaneously with both arms or independently, a feature which is particularly desirable for rehabilitation.

While a preferred embodiment of the invention has been described, it is to be understood that the invention is not limited thereby and that in light of the present disclosure various other alternative embodiments will be apparent to a person skilled in the art. For instance, the structural orientation of some parts or portions of the frame 11 is not critical, so long as the position of the lever pivot axes, the lever lengths, the handles, and the tilted planes through which the levers rotate are maintained. Additionally, while the particular angles of the sides of the frame 11 and the handle angles shown are considered to be optimum at the present time, based upon feedback from those involved in strength training, it is entirely possible that some further refinements may evolve. Accordingly, it is to be understood that some modification may be made without departing from the scope of the invention as particularly set forth and claimed.

I claim:

1. A behind the neck pulldown exercise machine comprising:

a frame having a vertical midplane;

a seat connected to the frame and bisected by the midplane and adapted to support an exerciser facing a forward direction along the midplane;

a lever pivotally connected to the frame forward of and above the seat, the lever having a forward end and a rearward end;

a handle connected to the rearward end of the lever and adapted to be grasped by an exerciser supported on the seat and pulled downwardly in a behind the neck pulldown motion, with the palm of the exerciser facing in the forward direction and the thumb pointed inwardly toward the midplane, thereby to pivot the lever along a plane of motion which tilts downwardly from vertical toward the midplane and;

weight resistance means operatively connected to the lever to resist pivotal movement of the lever during the behind the neck pulldown motion by the exerciser.

2. The exercise machine of claim 1 wherein the lever pivot plane tilts downwardly at an angle of about 10°.

3. The exercise machine of claim 1 wherein the handle further comprises:

a rod with a central bend defining first and second portions with an angle of about 65° therebetween, the first portion fixedly connected to the rearward end of the lever.

4. The exercise machine of claim 3 wherein the second portion is oriented at an angle of about 108.5° with respect to the forward direction of the frame.

5. The exercise machine of claim 1 and further comprising:

exerciser hold-down means for preventing upward movement of an exerciser from the seat during a pulldown motion.

6. The exercise machine of claim 5 and further comprising:

means for vertically adjusting the position of the exercise hold-down means with respect to the frame.

7. The exercise machine of claim 1 wherein, in an initial at rest position, the forward end of the lever tilts downwardly at an angle of about 45° from horizontal.

8. The exercise machine of claim 7 and further comprising:

a stop connected to the lever forward end and adapted to engage the frame when the lever is in the at rest position.

9. The exercise machine of claim 1 and further comprising:

means for vertically adjusting the seat with respect to the frame.

10. The exercise machine of claim 1 and further comprising:

a second lever located on an opposite side of the midplane, the levers being symmetric with each other with respect to the midplane.

11. A behind the neck pulldown exercise machine comprising:

a frame;

a seat connected to the frame and adapted to support an exerciser facing forwardly along a vertical midplane which bisects the frame;

a pair of levers pivotally connected to the frame above and forward of the seat on opposite sides of the midplane, each of the levers being pivotal along a plane of motion which tilts downwardly from vertical toward the midplane, each lever having a forward end and a rearward end;

a pair of handles located on opposite sides of the midplane, each handle connected to a rearward end of a respective lever, the handles adapted to be grasped by an exerciser supported on the seat and pulled downwardly in a behind the neck pulldown motion, with the palms of the exercise facing in the forward direction and the thumbs pointed inwardly toward the midplane, thereby to pivot the levers along planes of motion which tilt downwardly from vertical toward the midplane and;

a pair of weight resistance means, each said weight resistance means operatively connected to a respective lever to resist pivotal movement of the lever during the behind the neck pulldown motion.

12. The exercise machine of claim 11 wherein the levers pivot through planes which tilt downwardly at angles of about 10°.

13. The exercise machine of claim 11 and further comprising:

exerciser hold-down means connected to the frame in front of the seat and adapted to engage the tops of the thighs of an exerciser supported on the seat and prevent upward movement of the exerciser during a behind the neck pulldown motion.

14. A behind the neck pulldown exercise machine comprising:

a frame;

a seat connected to the frame along a vertical midplane through the frame and adapted to support an exerciser in a forward facing direction;

hold-down means connected to the frame forward of the seat and adapted to engage the top of the thighs of an exerciser supported on the seat; and a pair of behind the neck pulldown means pivotally connected to the frame on opposite sides of the midplane, each behind the neck pulldown means adapted to be grasped and pulled downwardly, by an exerciser supported on the seat, with the palm of the exerciser facing in the forward direction and the thumb pointed inwardly toward the midplane, in a behind the neck pulldown motion through and along a plane of movement which tilts downwardly from vertical toward the midplane, thereby to exercise a muscle group which includes the latissimus dorsi, the rhomboids, the anterior and posterior deltoids and the trapezoids, the hold-down means preventing upward movement of the exerciser during pulldown.

15. The exercise machine of claim 14 and further comprising:

means for vertically adjusting the seat.

16. The exercise machine of claim 14 and further comprising:

means for vertically adjusting the hold-down means.

* * * * *